US006006369A

United States Patent [19]

Bly

[11] Patent Number: 6,006,369

[45] Date of Patent: Dec. 28, 1999

[54] COMMODE SEAT AND LID COMBINATION

[75] Inventor: Robert R. Bly, Wellington, Ohio

[73] Assignee: Invacare Corporation, Elyria, Ohio

[21] Appl. No.: 08/842,701

[22] Filed: Apr. 15, 1997

Related U.S. Application Data

[63] Continuation of application No. 08/501,969, Jul. 14, 1995, abandoned, which is a continuation of application No. 08/271,426, Jul. 7, 1994, abandoned, which is a division of application No. 07/855,177, Mar. 18, 1992, abandoned, which is a continuation of application No. 07/589,457, Sep. 27, 1990, abandoned, which is a division of application No. 07/326,229, Mar. 20, 1989, Pat. No. 4,962,551.

[51] Int. Cl.[6] ..... A47K 13/12

[52] U.S. Cl. ..... 4/236

[58] Field of Search ..... 4/236, 240, 449, 4/460, 479, 480, 483; 16/225, 227, DIG. 13; 297/335, DIG. 2

[56] References Cited

U.S. PATENT DOCUMENTS

| | | | |
|---|---|---|---|
| 1,092,920 | 4/1914 | Knox | 4/460 X |
| 1,428,627 | 9/1922 | Grabfelder | 4/483 X |
| 1,563,236 | 11/1925 | Smith | 4/460 X |
| 2,023,514 | 12/1935 | Castanien | 4/483 X |
| 2,221,991 | 11/1940 | Myers et al. | 4/240 X |
| 2,283,892 | 5/1942 | Leslie | 4/240 |
| 2,333,732 | 11/1943 | Morris | 4/240 |
| 2,585,771 | 2/1952 | Harris | 4/480 |
| 2,913,732 | 11/1959 | Jones | 4/480 |
| 3,017,034 | 1/1962 | Klein | 4/240 X |
| 3,054,643 | 9/1962 | Militano | 297/DIG. 2 |
| 3,083,066 | 3/1963 | Bedol | 108/119 X |
| 3,146,028 | 8/1964 | Grosfillex | 297/DIG. 2 |
| 3,253,860 | 5/1966 | Shapiro | 297/254 X |
| 3,277,500 | 10/1966 | Carlson | 16/225 |
| 3,341,864 | 9/1967 | Wichmann | 4/480 |
| 3,349,727 | 10/1967 | Hamilton et al. | 108/119 |
| 3,393,941 | 7/1968 | Grosfillex | 297/457 X |
| 3,441,975 | 5/1969 | Shepherd | 16/225 |
| 3,447,169 | 6/1969 | Watson | 4/240 |
| 3,471,874 | 10/1969 | Dixon | 4/240 |
| 3,512,187 | 5/1970 | Thomas et al. | 4/480 X |
| 3,562,852 | 2/1971 | Gutshall | 16/225 X |
| 3,619,820 | 11/1971 | Cain et al. | 4/254 |
| 3,754,300 | 8/1973 | Shephered | 16/225 |
| 3,795,923 | 3/1974 | Thomas | 4/483 |
| 3,820,175 | 6/1974 | Waldon | 4/236 |
| 3,829,908 | 8/1974 | Thomas | 4/483 |
| 3,854,773 | 12/1974 | Thomas | 4/480 X |
| 3,950,794 | 4/1976 | Dalton | 4/240 X |
| 4,052,087 | 10/1977 | Gagliardi | 4/483 X |
| 4,173,802 | 11/1979 | Wikstrom | 4/236 |
| 4,187,561 | 2/1980 | Bogan | 4/449 |
| 4,287,619 | 9/1981 | Brewer et al. | 4/483 |
| 4,408,430 | 10/1983 | Wangler et al. | 16/DIG. 13 |
| 4,510,631 | 4/1985 | Grady | 4/478 |
| 4,606,080 | 8/1986 | Clementino | 4/460 |
| 4,680,816 | 7/1987 | Colombani | 4/240 |
| 4,787,590 | 11/1988 | Melvin | 16/227 X |
| 4,823,412 | 4/1989 | Spiegel | 4/483 |
| 4,837,868 | 6/1989 | Allen | 4/480 |
| 4,939,796 | 7/1990 | Pepper | 4/236 |

FOREIGN PATENT DOCUMENTS

| | | | |
|---|---|---|---|
| 3248260 | 9/1983 | Germany | 4/236 |
| 602911 | 3/1960 | Italy | 4/236 |
| 347317 | 1/1957 | Switzerland . | |
| 839049 | 6/1960 | United Kingdom | 4/240 |

*Primary Examiner*—Robert M. Fetsuga
*Attorney, Agent, or Firm*—Hudak & Shunk Co., LPA

[57] ABSTRACT

A portable commode comprises legs which support a tubular frame. The frame defines a chair-like configuration that includes an arm support and front and rear parallel horizontal cross bar members. A seat has an integrally molded seat clamp that projects from a rear portion thereof. The seat clamp has a groove that is situated away from a bottom plane of the seat and configured for locking receipt on, and pivotal movement about, the rear cross bar member. The commode also includes a lid which has an integrally molded lid clamp that projects from a rear portion thereof. The lid clamp has a groove that is situated diametrically away from a bottom plane of the lid and is configured for pivotal receipt on the rear cross bar member.

4 Claims, 5 Drawing Sheets

COMMODE SEAT AND LID COMBINATION

This is a continuation of application Ser. No. 08/501,969 filed on Jul. 14, 1995, now abandoned, which is a continuation of Ser. No. 08/271,426 filed on Jul. 7, 1994, now abandoned, which is a divisional of Ser. No. 07/855,177 filed on Mar. 18, 1992, now abandoned, which is continuation of Ser. No. 07/589,457 filed on Sep. 27, 1990, now abandoned, which is a divisional of Ser. No. 07/326,229 filed Mar. 20, 1989, now U.S. Pat. No. 4,962,551.

BACKGROUND OF THE INVENTION

The present invention relates to the art of portable commodes for patient care and invalid assistance. It finds particular application in conjunction with portable commodes having separate, detachable seats or lids, and will be described with particular reference thereto. It is to be appreciated, however, that the invention has broader application and may be advantageously employed in other environments.

Heretofore, commode seats and lids have been received on portable commode frames by various means. For instance, fastening devices such as nuts, bolts or screws have been used to mount seats and lids directly to portable commode frames. Fasteners have also been used to mount seats and lids when hinges were used.

It has also been known to mount commode seats or lids to portable commode frames using clamps. These clamps were fastened onto the seat or lid with a metal fastener, and were configured to clip around the outer periphery of a portable commode tubular cross bar member.

There are a number of problems with the above-mentioned techniques for attaching seats or lids to portable commode frames. First, such techniques require extra manufacturing steps. Hinges and clamps must be fastened into place, and the seat or lid must then be attached to the frame. Second, many of the prior art clamps, hinges and fasteners are made of metal, and tend to rust or fall away. Finally, many of the prior art clamps are flimsy, and often loosen or loose their shape. This problem results in the seat not remaining securely in place.

In portable commodes which have separately detachable seats or lids, it is desirable that no separate fasteners, hinges or clamps be required in mounting the seat or lid on the portable commode frame. Previous portable commodes which had separately detachable seats or lids required additional fasteners and hinge members, and provided excessive manufacturing steps in forming the portable commode.

It would be desirable to have a portable commode with a detachable seat or lid wherein the seat or lid would be securely received on the portable commode frame without the use of additional fasteners, clamps or hinges.

The present invention contemplates a new and improved portable commode which overcomes the above-referenced problems and others.

SUMMARY OF THE INVENTION

In accordance with the present invention, there is provided a portable commode having a tubular frame that includes a tubular rear cross bar member. The portable commode includes a separately removable seat and lid. The seat and lid each have integrally molded clamps extending downwardly from their respective bottom planes. The clamps are suited for pivotal receipt on the rear cross bar member.

In accordance with a more limited aspect of the invention, a portable commode is provided. The portable commode comprises legs which support a tubular frame. The frame defines a chair-like configuration that includes an arm support and front and rear parallel horizontal cross bar members. The commode further comprises a container, and a means for hanging or holding the container. In addition, the commode includes a seat that is pivotally received on the rear cross bar member, and rigidly supported by the front cross bar member. The seat has an integrally molded seat clamp that projects from a rear portion thereof. The seat clamp has a groove that is situated away from a bottom plane of the commode seat and configured for locking receipt on, and pivotal movement about, the rear cross bar member.

Similarly, a lid is pivotally received on the rear cross bar member adjacent the seat. The lid can be moved from a closed position on the seat to an open position away from the seat. The lid has an integrally molded lid clamp that projects from a rear portion thereof. The lid clamp has a groove that is situated diametrically away from a bottom plane of the lid and is configured for receipt on and pivotal movement about the rear cross bar member.

One advantage of the present invention is that fewer pieces are required in assembling the seat. Since the clamps are integrally molded with the seat and lid, hinges and other fastening devices are not necessary.

Another advantage of the present invention is that the clamps are integrally molded with the seat and lid. That is, the seat and lid and clamps are comprised of molded plastic. There are no metal hinges, screws or other fasteners which can rust or fall away.

Yet another advantage of the present invention is that because the clamps are integrally molded with the seat and lid, they are not likely to break away, and the seat and lid are likely to remain securely received on the portable commode frame.

Still further advantages of the present invention will become apparent to those of ordinary skill in the art upon a reading and understanding of the following detailed description of the preferred embodiment.

BRIEF DESCRIPTION OF THE DRAWINGS

The invention may take part in various parts and arrangements of parts. The drawings are only for purposes of illustrating a preferred embodiment and are not to be construed as limiting the invention.

DETAILED DESCRIPTION OF THE PREFERRED AND ALTERNATIVE EMBODIMENTS

Figure 1:
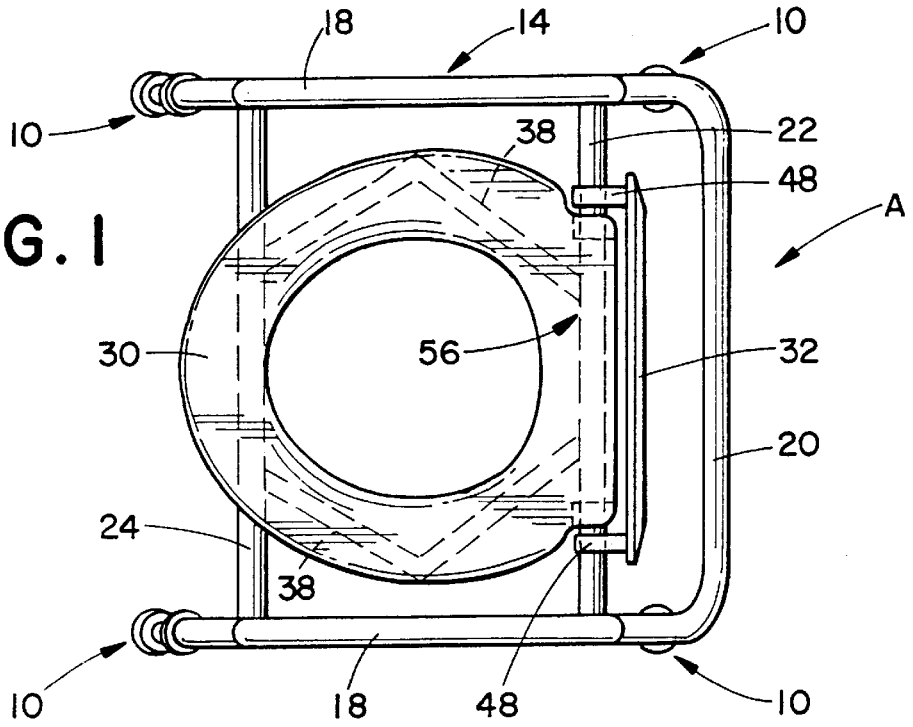
FIG. 1 is a plan view of a portable commode in accordance with the present invention.
Figure 2:
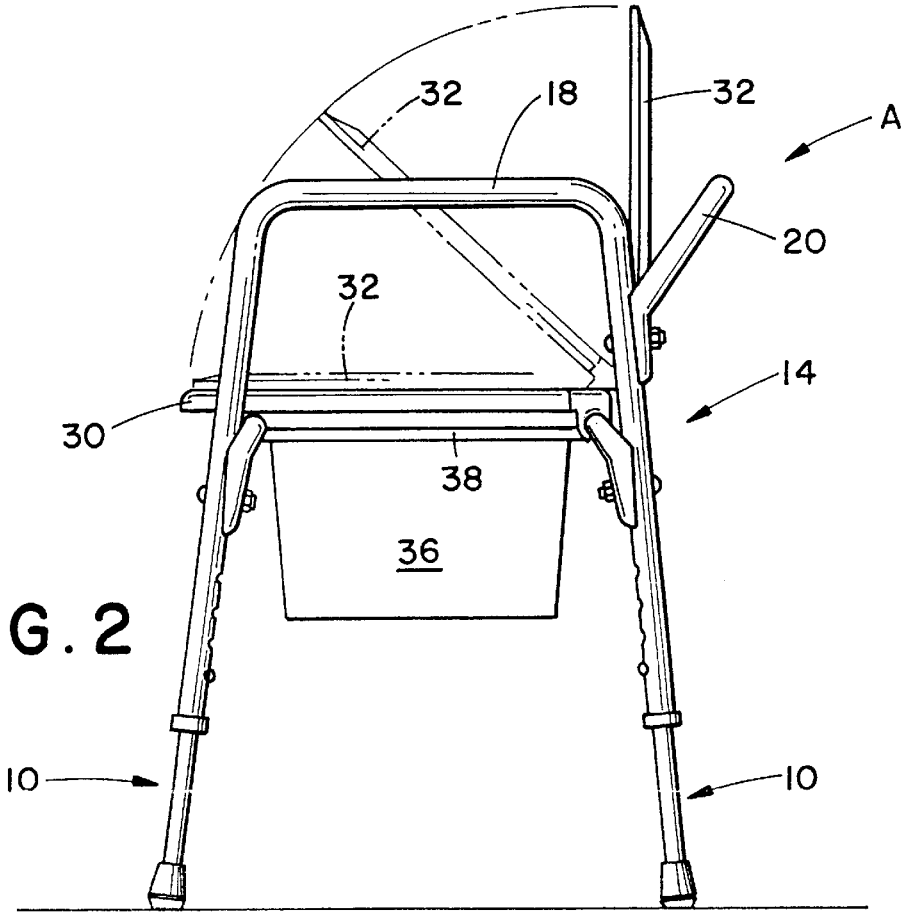
FIG. 2 is an elevational view of a portable commode in accordance with the present invention.

With reference to FIGS. 1 and 2, a portable commode A includes telescopically adjustable legs 10 which support a tubular frame 14. The tubular frame is of chair-like configuration and includes arm supports 18, a back tube 20, a rear horizontal cross bar member or elongated cylindrical rod 22, and a front horizontal cross bar member 24. A seat 30 is pivotally received on rear cross bar member 22, and rests on front horizontal cross bar member 24. Front cross bar member 24 provides rigid support for seat 30. The seat 30 is a generally planar member with a generally circular periphery. The periphery may or may not define an opening. The planar member defines a hole that passes therethrough.

A lid 32 is also pivotally received on rear horizontal cross bar member or elongated cylindrical rod 22. Lid 32 can pivot from a closed position on the seat 30 as shown in phantom in FIG. 2, to an open position as also shown in FIG. 2. The lid 32 is a generally planar member with a generally curved or circular periphery.

A container or bucket 36 is shown in FIG. 2. The container hangs or is held beneath the commode seat 30 and is mounted on the portable commode by a container holding or hanging means 38. Container holding means 38 are shown in phantom in FIG. 1 and elevationally in FIG. 2. The container is slid between the holding means 38 and rests in place until manually removed at a later time. Of course, it will be appreciated that other means for holding the container 36 can be incorporated into the present invention. The holding means shown in the FIGURES merely provide a suggested embodiment of one type of holding means, and different holding means can be incorporated into the portable commode.

Although they are shown in FIGS. 1 and 2, the back tube 20 and lid 32 are optional features of the present invention. By omitting or removing these features, the portable commode can be placed against a standard water tank and used in combination with an existing built-in commode or toilet. Of course, if such use is made, the container or bucket 36 also becomes an optional feature, as do holding means 38.

It is to be noted that the legs 10 are telescopically adjustable. By adjusting the legs, the commode seat can be elevated and lowered. Such ability to adjust the seat height facilitates use of the portable commode by persons of varying height and stature. In addition, an existing built in toilet may be accomodated.

Figure 4:
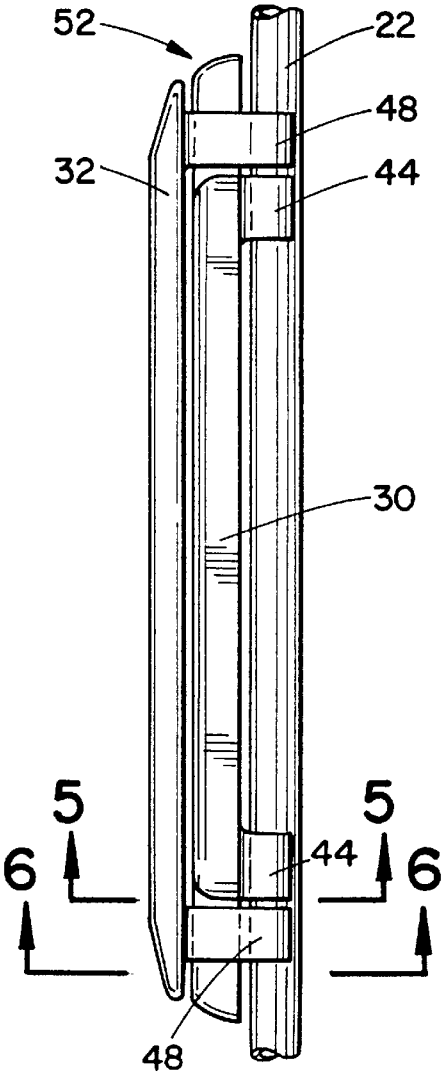
FIG. 4 is an elevational view of the seat and lid as they are clamped onto a rear tubular cross bar member.
Figure 3:
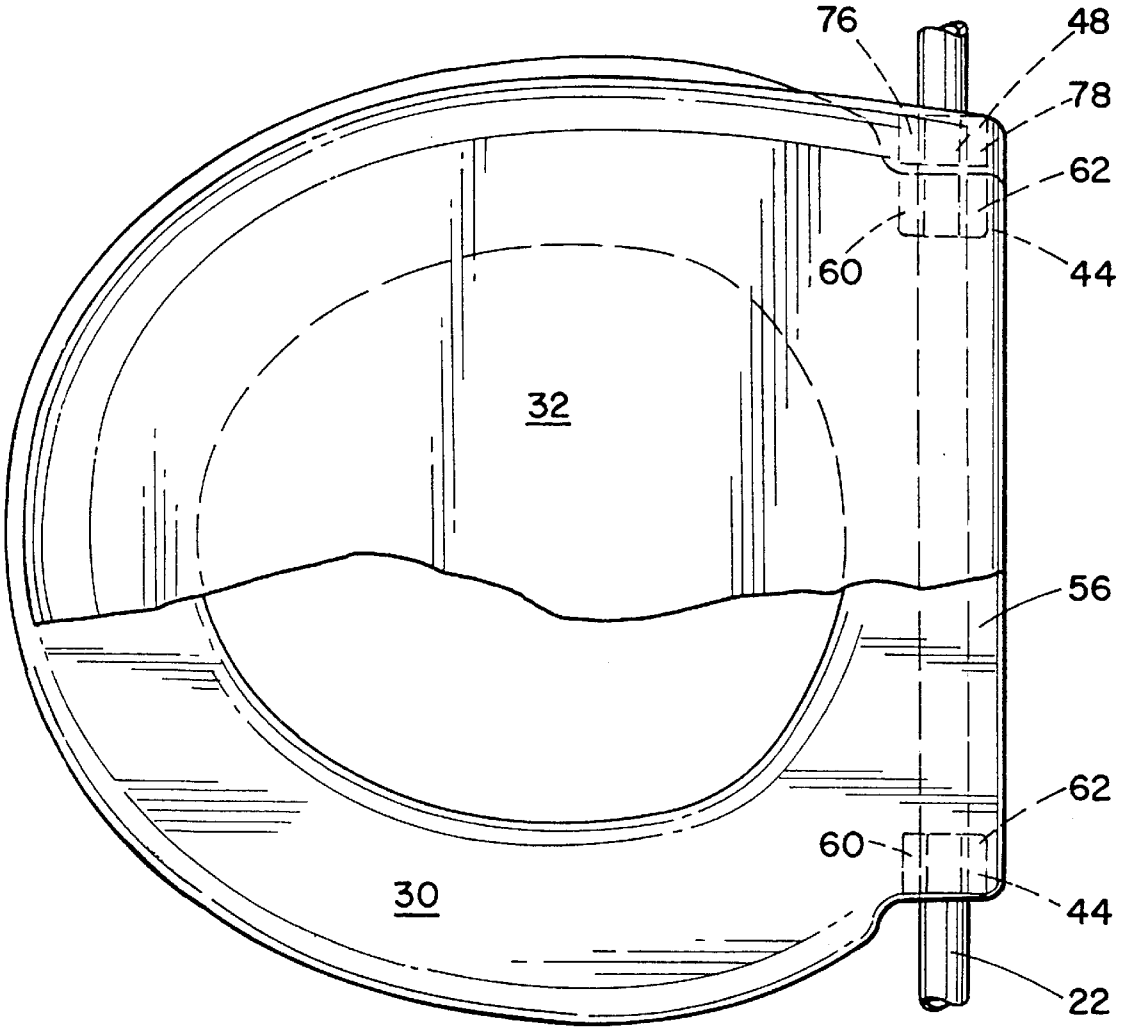
FIG. 3 is a plan view of a seat and lid in accordance with the present invention, with a portion of the lid broken away to show the seat.

Turning now to FIGS. 3 and 4, it will be noted that the seat 30 and lid 32 are separately but adjacently mounted on rear cross bar member 22. Both the seat and the lid are molded from polypropylene and have integrally molded snap clamps depicted generally by 44 and 48. The clamps extend from a rear peripheral edge of a bottom plane of the seat or lid, respectively. The integrally molded seat clamps 44 project downward from a rear peripheral edge of a bottom plane of seat 30. As clearly set forth in FIG. 5, the seat clamps 44 have a C-shaped groove 50 situated away from the commode seat for locking receipt on and pivotal movement about rear cross bar member 22.

The integrally molded lid clamps 48 also project downward from a rear peripheral edge of a bottom plane of lid 32. As set forth in FIG. 6, the lid clamps 48 have a C-shaped groove 51 situated away from a bottom plane of the lid 32 for locking receipt on and pivotal movement about rear cross bar member 22.

Referring to FIG. 4, the lid clamps 48 extend downward to a greater extent than do the seat clamps. When the lid 32 is in closed position and at rest on top of the seat 30 as shown in FIGS. 2 and 4, the seat thickness 52 is taken into consideration. The lid 32 thus remains pivotally received on the rear tubular member 22 when the lid is in a closed position.

As will be further noted, a portion 56 of the seat 30 tapers inward near the rear portion of the seat 30. The seat clamps 44 are positioned at extreme ends of this tapered rear portion. The seat 30 and lid 32 are separately pivotable about cross bar 22.

The lid clamps 48 are each positioned closely adjacent a seat clamp 44. Both lid clamps shown in FIGS. 3 and 4 are located outward of the seat clamps. The FIGURES disclose that two (2) integral snap clamps extend from each of the commode seat 30 and the lid 32. Although this arrangement is preferred, it is foreseeable that the seat could have a single integral clamp, and further that the lid could have a single integral clamp. It is further conceivable that the seat could have three or more clamps, and the lid could have three or more clamps.

Figure 5:
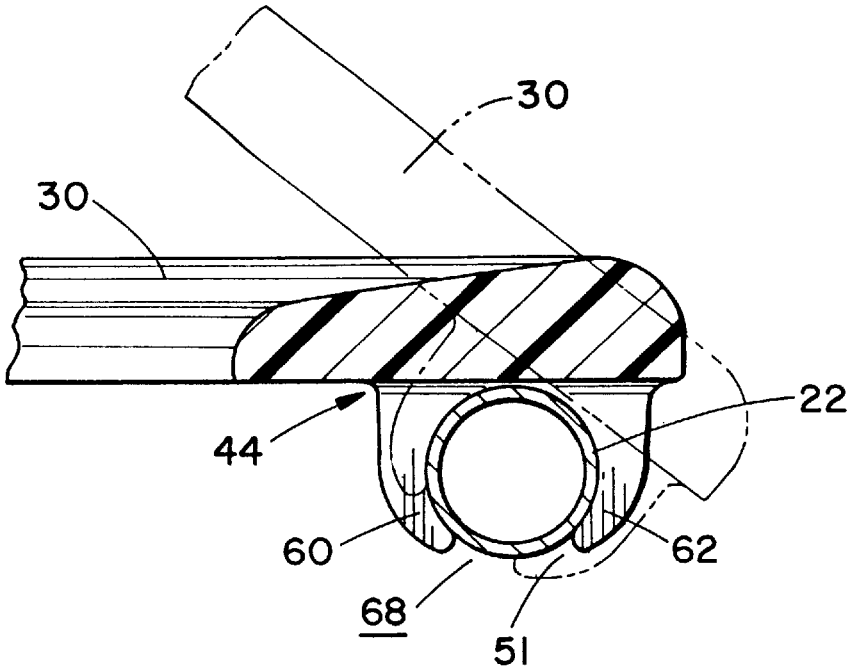
FIG. 5 is a partial cross-sectional and broken-away view of a seat clamp, the view taken along line 5—5 of FIG. 4.
Figure 6:
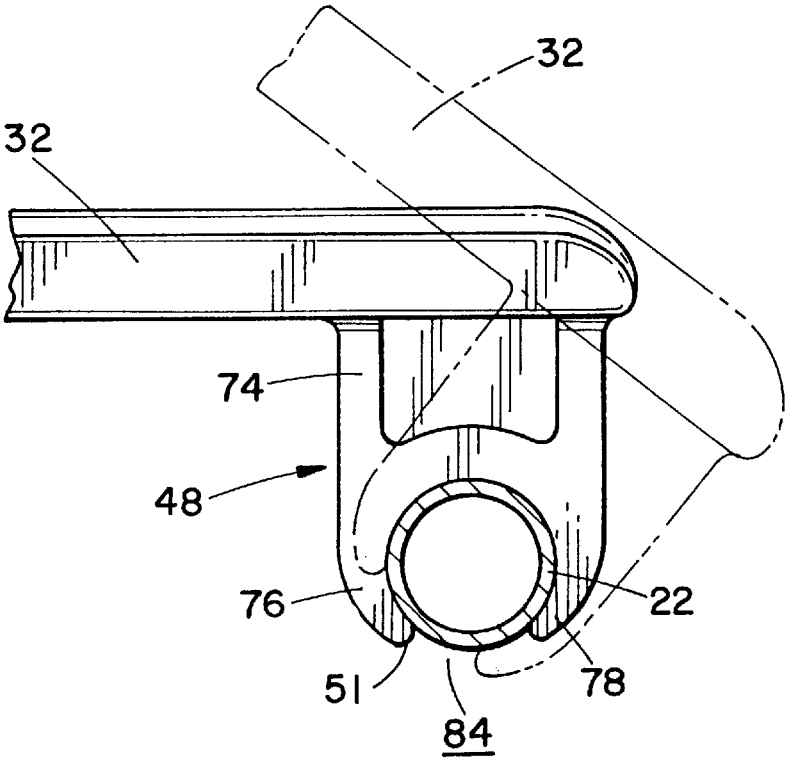
FIG. 6 is a broken-away view of a lid clamp taken along line 6—6 of FIG. 4; and, FIG. 7A is a cross-sectional view of a lid clamp in accordance with an alternate embodiment of the present invention.

With specific reference to FIGS. 5 and 6, the seat clamp 44 and the lid clamp 48 are shown in detail. FIG. 5 particularly shows the seat clamp 44. First and second curved flanges 60 and 62 extend generally downward from the bottom plane of seat 30. Flanges 60 and 62 are integrally molded as a part of the seat 30 and have inner walls which individually define circular arcs and together define C-shaped groove 50 for pivotal receipt of elongated rod or rear cross bar member 22. The inner diameter of the groove 50 is slightly smaller than the outer diameter of the cross bar member 22, with an interference fit in the preferred embodiment of 0.020. The inner walls extend circumferentially an extent that is greater than 180°. In the preferred embodiment, the C-shaped groove extends approximately 240°. Any circumferential extent that is greater than 180° provides a downturn of the flanges. Such downturn provides a locking action to maintain the seat clamp 44 on the cross bar 22. The flanges 60 and 62 further define an opening 68 through which cross bar member 22 must pass, with recoverable deformation of the seat clamp, before the cross bar is slidingly and lockingly received in the C-shaped groove 50. FIG. 5 also shows a phantom view of the seat 30 as it pivots around rear cross bar member 22.

FIG. 6 shows the lid clamp 48 as it extends from the lid 32 being integrally molded into the lid. The lid clamp 48 has a base or connecting means 74 which allows the clamp to extend so as to reach the cross bar member 22 when the lid 32 is in place on the seat 30 as shown in FIG. 4. The lid clamp 48 further includes first and second curved flanges 76 and 78, which extend from the base 74. Flanges 76 and 78 have inner walls which individually define circular arcs and together define C-shaped groove 51. The inner diameter of the groove 51 is slightly smaller than the outer diameter of the cross bar member 22, with an interference fit in the preferred embodiment of 0.020. Having a conformation that is similar to the seat clamp flanges, the lid clamp flanges 76 and 78 define a flange opening 84 through which the cylindrical rear cross bar member or elongated rod 22 can be slidingly and lockingly received, with recoverable deformation to the lid clamp. Further, the lid clamp flanges extend circumferentially a distance greater than 180°. In the preferred embodiment, the C-shaped groove extends approximately 240°. The circumferential extent greater than 180° provides a downturn which incorporates a locking action that maintains the lid clamp 48 on the rear cross bar 22.

The extent to which the groove extends is a function of elasticity. The more elastic a material, the further it may be wrapped around the rod. The seat, lid and clamps of the present invention are molded from polypropylene. Hence, the groove extends approximately 240° around the rod 22. The degree of extension would increase or decrease when other resins are used.

The required recoverable deformation can be enhanced by tapering down the thickness of flanges 60 and 62 toward their ends. This provides increased deformation at the end of the flange, and rigidity at the center thereof.

There is an interference fit in the preferred embodiment of 0.020 between the rod 22 and the clamps 44 and 48. The outer diameter of the rod is larger than the inner diameter of the C-shaped grooves 50 and 51 defined by the clamp flanges. Consequently, there is a snug fit between the clamps and the rod.

It will be noted from the FIGURES, particularly FIGS. 3 and 4, that when the lid and seat are in place and clamped onto the rear cross bar member 22, the circular portions defined by the respective grooves 50 and 51 are parallel or cocylindrical. That is, they contemporaneously and adjacently fit snugly about the same cylindrical cross bar member 22.

Figure 7A:
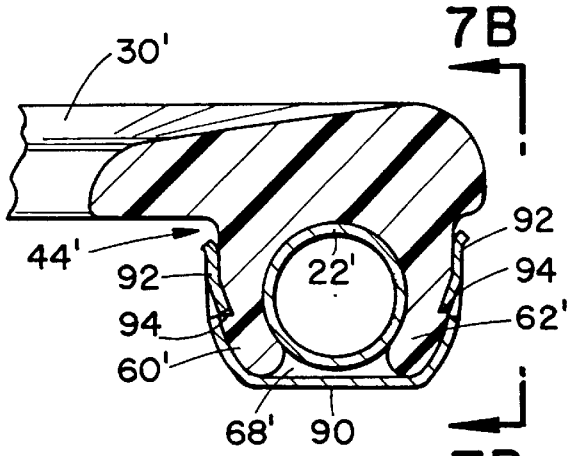
FIG. 7B is an elevational view taken along line 7B—7B of FIG. 7A.
Figure 7B:
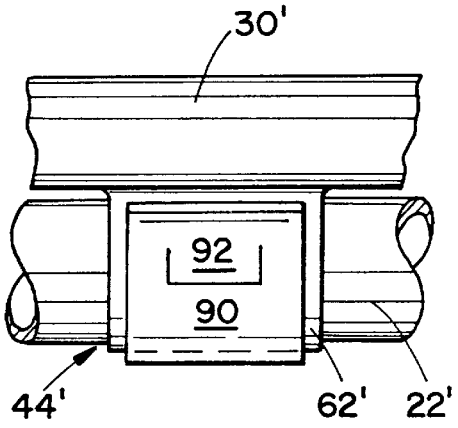

FIGS. 7A and 7B show one alternate embodiment which adheres to the broad concepts of the subject invention. For ease of illustration and appreciation of this alternative embodiment, like components are identified by like numerals with a primed (') suffix, and new components are identified by new numerals.

Referring to FIGS. 7A and 7B, the overall seat clamp construction is substantially identical to that previously described above. The only significant modification resides in a clamp closure 90 which serves to lock the seat clamp 44', and hence the seat 30', to rod 22'. The closure attempts to prevent unwanted purposeful or accidental removal of the seat 30' from the commode.

The closure 90 can be compromised of a metal spring or plastic cover. Essentially, the closure is of a general U-shaped configuration. It fits snuggly on the outside of curved flanges 60' and 62', and extends across opening 68' defined by the flanges. Tabs or projections 92 extend downward and inward from extreme edges of the U. The tabs 92 can either have a smooth edge or a serrated edge, with a serrated edge providing a tighter grip on the clamp.

Outer walls of the clamp 44' define narrow slits 94 for receipt of the tabs 92. Once the seat is in place on rod 22', the closure 90 is snapped into place across opening 68' in clamp 44'. Tabs 94 fit into slits 92, and the closure remains securely in place. The seat clamp 44' cannot be removed from rod 22' until closure 90 is removed. Closure 90 can be removed either manually or by using hand tools.

Figure 8A:
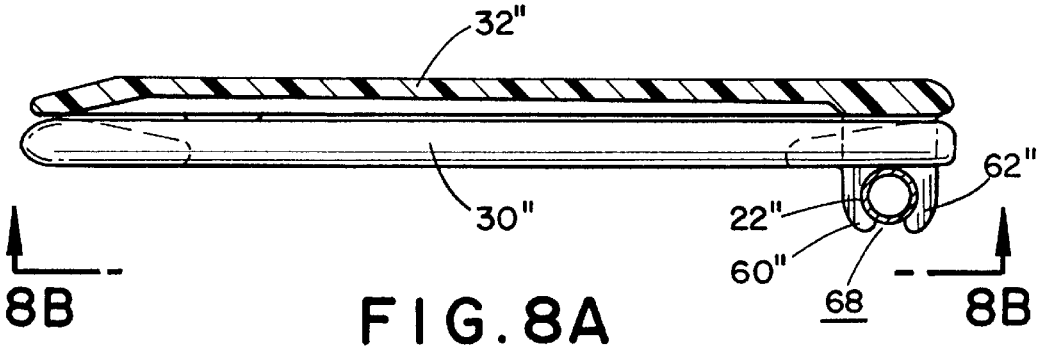
FIG. 8A is a side elevational view of a seat and lid, with the lid shown in cross section.
Figure 8B:
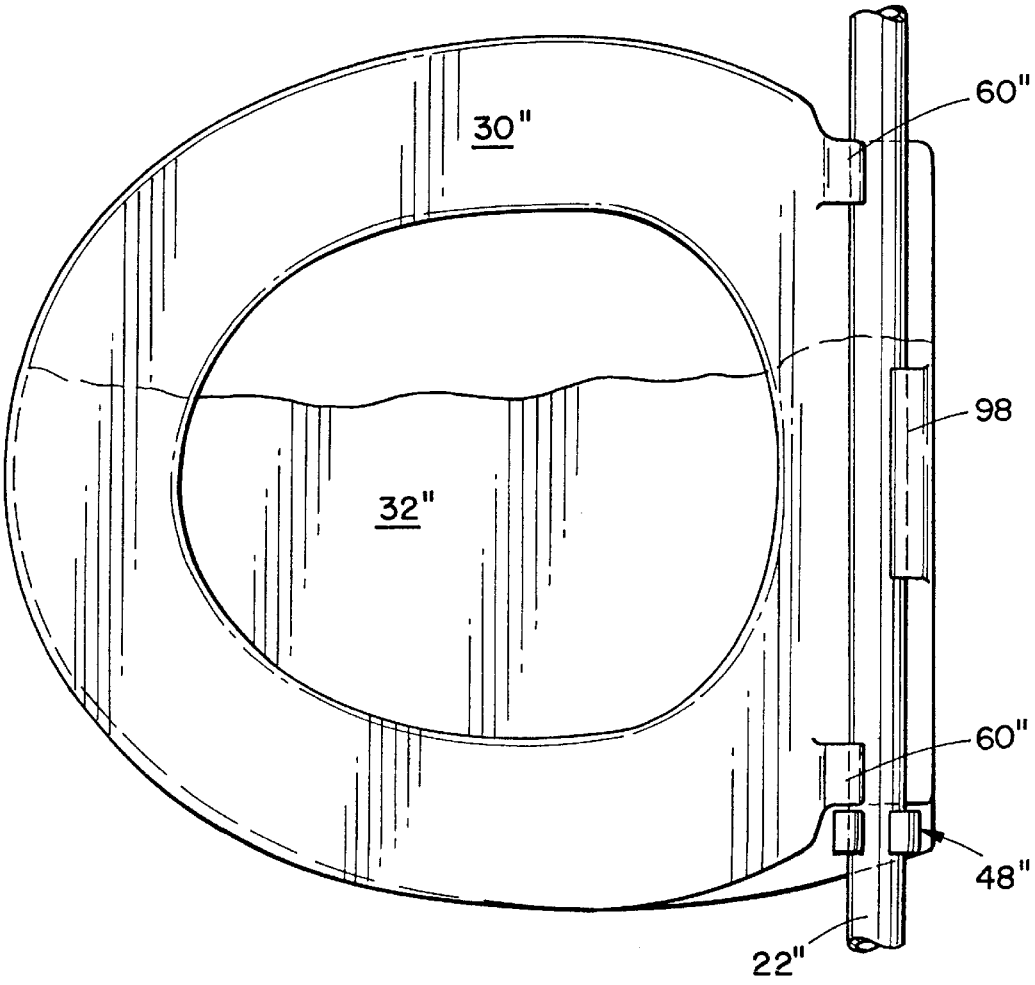
FIG. 8B is a bottom view of a seat and lid showing an alternate embodiment of a seat clamp with a portion of the lid broken away.

Still another alternative construction is shown in FIGS. 8A and 8B. Here, like components are identified by like numerals with a double primed (") suffix, and new components are identified by new numerals.

The essential difference of this embodiment lies in the seat clamp configuration. That is, this embodiment calls for a three-part clamp or hinge that is integrally molded with seat 30". Curved flanges 60" project downward from a rear portion of the seat 30" and make up two portions of the clamp. The flanges each have a curved inner wall that is directed toward a rear portion of the seat. Additionally, when seat 30" is mounted on rod 22", the flanges 60" are fitted along a first face of the rod.

A third curved flange 98 also extends from the seat. This third flange 98 includes a curved inner wall which is directed away from the rear portion of seat 30". Inner wall of flange 98 fits against a second face of elongated rod 22", the second face diametrically opposed from the first. In other words, and in contrast to the preferred embodiment, the flanges are offset from one another rather than contiguous.

A seat with a clamp or hinge of this second embodiment can be pivotally received on an elongated rod or cross bar 22". As FIG. 8B discloses, cross bar 22" fits between the flanges, with flanges 60" to one side of the bar 22", and flange 98 to the other side.

Figure 9:
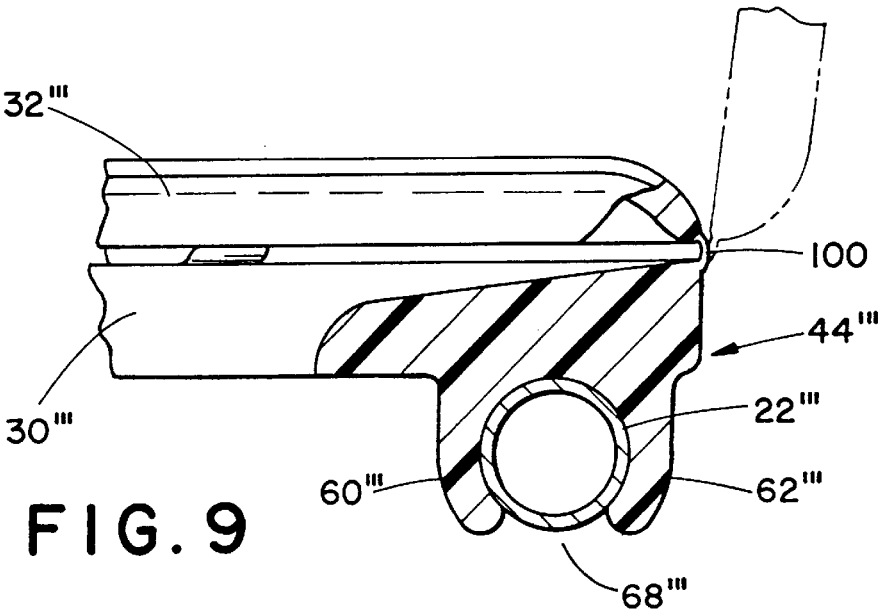
FIG. 9 is a broken away elevational view of a seat and lid in partial cross section showing an alternate embodiment of the present invention; and, FIG. 10 is a broken away elevational view of a seat and lid in partial cross section showing an alternate embodiment of the present invention.
Figure 10:
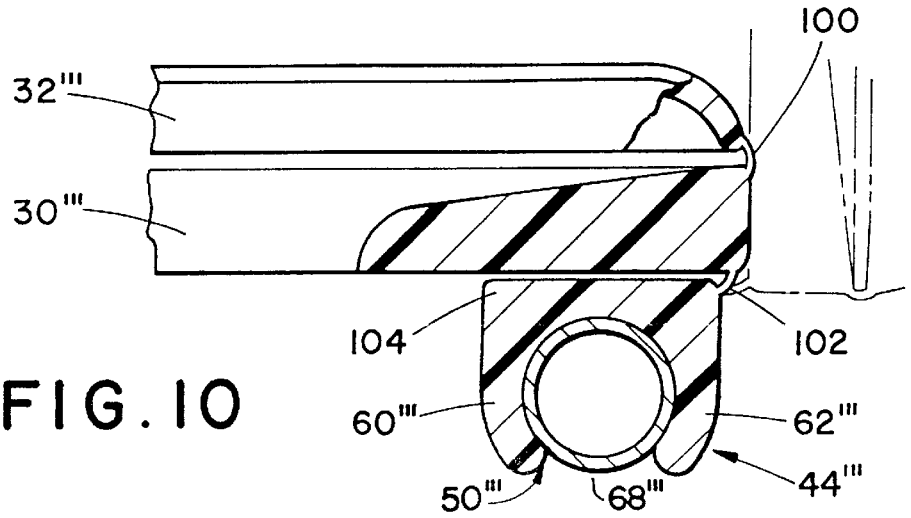

A third alternative embodiment is set forth in FIGS. 9 and 10. For ease of illustration, like elements are designated with triple primes ('''), and new elements are identified by new numerals.

Turning first to FIG. 9, a commode seat 30''' and lid 32''' are shown, with the lid in a closed position on the seat. The seat is received on elongated rod 22''' in a manner similar to that shown in FIG. 5. The lid, however, is integrally molded with the seat, with a thin film or sheet 100 of ductile polypropylene joining the seat and lid. The thin ductile sheet 100 acts as a hinge, and the lid can be pivoted from closed to open positions relative to the seat.

FIG. 10 shows the same thin ductile hinge 100 joining the seat and lid as is set forth in FIG. 9. FIG. 10 additionally shows a similar thin material 102 between seat clamp 44''' and the seat. This would allow the seat to pivot between the lid and clamp. The clamp includes a base 104 with curved flanges 60''' and 62''' projecting relative to one another such that inner walls of the flanges together form a C-shaped groove 50''' that is essentially a 240° arc. In this embodiment, the lid, seat and clamp are integrally molded.

The difference between this embodiment and the others resides in the stationary clamp 44'''. While the seat and lid are independently pivotable, the clamp remains in place on the rod. The clamp closure 90 shown in FIG. 7A and 7B could be incorporated into the clamps of FIGS. 9 and 10 or the clamps of FIGS. 8A and 8B.

The invention has been described with reference to the preferred embodiments. Obviously, modifications and alterations will occur to others upon reading and understanding the preceding specification. It is intended that the invention be construed as including all such alterations and modifications insofar as they come within the scope of the appended claims or the equivalents thereof.

Having thus described the preferred embodiments, the invention is now claimed to be:

1. A commode seat and lid combination for securement to an elongated cylindrical rod, said combination comprising:

a generally planar seat member having top and bottom surfaces defining a curved periphery and a hole passing therethrough, the seat member further including first and second spaced seat clamps molded integrally with the seat member and each having a C-shaped groove defining an opening facing downward from and substantially perpendicular to said bottom surface of said seat member, said grooves being axially aligned, said clamps being formed of a resilient material and said openings being smaller than the diameter of said cylindrical rod such that said clamps are suited for gripping, pivotal receipt about said cylindrical rod when said seat clamps are forced over said rod and said rod is retained in said grooves;

a generally planar lid member having top and bottom surfaces defining a curved periphery; and a hinge member integrally molded between said seat member and lid member, said hinge member extending from an upper, outer edge portion of said seat member to a lower outer edge portion of said lid member for pivotally joining the lid member to the seat member.

2. A seat and lid combination, as set forth in claim 1, wherein the hinge member is comprised of a ductile material.

3. A commode seat and lid combination, as set forth in claim 1, wherein the seat member periphery is of generally circular configuration and the lid member periphery is of generally circular configuration.

4. A commode seat and lid combination for securement to an elongated cylindrical rod, said combination comprising:

a generally planar seat member having top and bottom surfaces defining a curved periphery and a hole passing therethrough, the seat member further including at least one seat clamp molded integrally with the seat member and having a substantially C-shaped groove defining an opening facing downward from and approximately perpendicular to said bottom surface of said seat member, said at least one clamp being formed of a resilient material and said opening being smaller than the diameter of said cylindrical rod such that said clamp is suited for gripping, pivotal receipt about said cylindrical rod when said seat clamp is forced over said rod and said rod is retained in said grooves;

a generally planar lid member having top and bottom surfaces defining a curved periphery; and a hinge member integrally molded between said seat member and lid member, said hinge member extending from a rear portion of said seat member to a rear portion of said lid member for pivotally joining the lid member to the seat member.

* * * * *